United States Patent [19]

Schindler

[11] 4,167,052

[45] Sep. 11, 1979

[54] APPARATUS FOR A POINT LASTING MACHINE TO FOLD OVER A SHAFT EDGE OF A SHOE

[75] Inventor: Herbert Schindler, Pirmasens, Fed. Rep. of Germany

[73] Assignee: Schon & Cie GmbH Maschinenfabrik, Pirmasens, Fed. Rep. of Germany

[21] Appl. No.: 848,747

[22] Filed: Nov. 4, 1977

[30] Foreign Application Priority Data

Nov. 5, 1976 [DE] Fed. Rep. of Germany ..... 2650680

[51] Int. Cl.[2] ..... A43D 21/12

[52] U.S. Cl. ..... 12/8.1; 12/12

[58] Field of Search ..... 12/8.1, 12, 7, 7.9, 12/8.2

[56] References Cited

U.S. PATENT DOCUMENTS

| | | | |
|---|---|---|---|
| 2,264,577 | 12/1941 | Lancaster | 12/8.1 |
| 3,678,522 | 7/1972 | Bumbatek et al. | 12/8.1 |

*Primary Examiner*—Patrick D. Lawson

*Attorney, Agent, or Firm*—Friedman, Goodman & Teitelbaum

[57] ABSTRACT

An apparatus is disclosed for a point lasting machine to fold over an edge of a shaft of a shoe or of a shoe upper at a ball and joint part of a last of the machine. The apparatus includes movable presser members for applying pressure against opposite side surfaces of the last when the shaft or upper is positioned thereon. Associated bands are connected to the presser members respectively for folding over the shaft edge against an underside of an insole of the shoe and for holding the shaft edge in its folded position against the insole. Preferably, the bands are fabricated from an elastic material. Each band extends transversely from its associated presser member for positioning against the respective shaft and shaft edge. A tensioning device is connected to each band for tensioning the band against the associated shaft and shaft edge to fold and hold the shaft edge. Preferably, each presser member includes an elastic member, such as a cushion, disposed at its working end, where the associated band is laid over and extends partially around the cushion.

15 Claims, 1 Drawing Figure

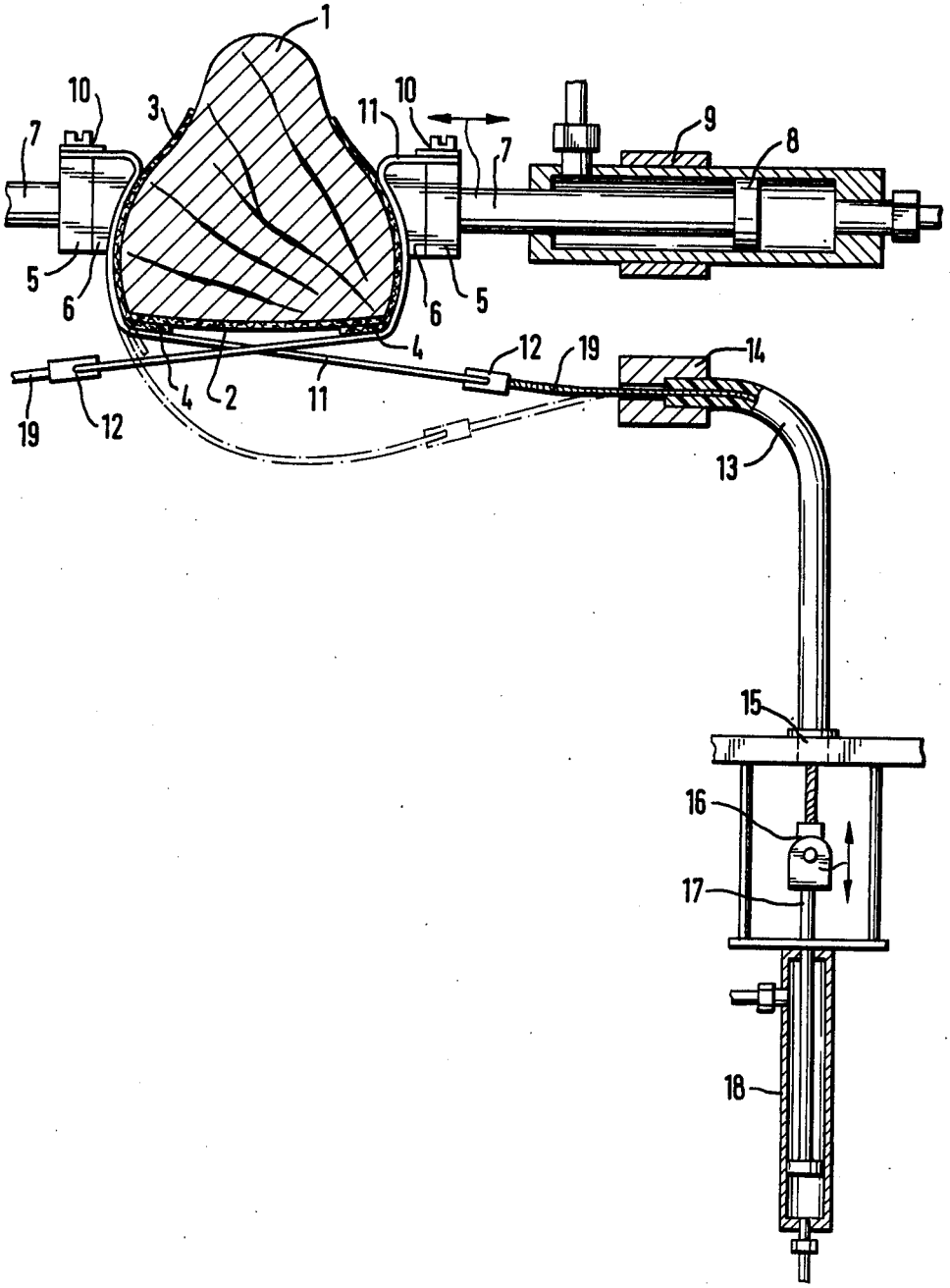
1
10
3
7
11
10
7
9
8
5
6
6
5
4
12
19
14
19
12
4
2
11
13
15
16
17
18

APPARATUS FOR A POINT LASTING MACHINE TO FOLD OVER A SHAFT EDGE OF A SHOE

BACKGROUND OF THE INVENTION

The present invention relates to an apparatus for a point lasting machine, and more particularly to an apparatus for folding over a shaft or upper edge of a shoe at a ball and joint part of a last of the point lasting machine.

Point lasting machines are well known in the art. However, in these machines it is quite possible that the leather of the shaft or upper, which is folded at the ball and joint part of the last, will escape or unfold and come out at the end of the reeving process, thus producing an undesired condition. The prior art does not disclose any apparatus for holding the shaft edge in a folded position against the insole of the shoe at the ball and joint part of the last immediately before the reeving process.

SUMMARY OF THE INVENTION

Accordingly, it is an object of the present invention to provide an apparatus for a point lasting machine which folds over a shaft edge of a shoe at a ball and joint part of a last of the machine which overcomes the disadvantages of the prior art.

Another object of the present invention is to provide an apparatus as described above which presses or folds the shaft edge onto the ball and joint part of the last or against the insole of the shoe, and holds the shaft edge in this position immediately before the reeving process.

A further object of the present invention is to provide an apparatus as described above which includes elastic bands for folding the shaft edge.

And yet another object of the present invention is to provide an apparatus as described above which includes presser members provided with cushions at their working end for applying pressure to the side surfaces of the last when the shaft is positioned thereon, the bands being laid over and extending partly around the cushions.

These objects are achieved in accordance with a preferred embodiment of the present invention, where the apparatus comprises movable presser means for applying pressure against a side surface of the last having the shaft or upper positioned thereon, band means connected to the presser means for folding over the shaft or upper edge against an underside of the shoe insole and for holding the shaft edge in this folded position against the insole which is disposed on the last sole, the band means extending transversely from the presser means for positioning against the shaft and shaft edge, and a tensioning device connected to the band means for tensioning the band means against the shaft and the shaft edge to fold and hold the shaft edge. Preferably, the front or working end of the presser means is elastic, for example, being in the form of a cushion. The band is laid over and extends partly around this cushion end. Preferably, the band means includes bands fabricated from an elastic material. The tensioning device, which is also capable of both tensioning and relaxing the band or bands, includes a double-acting pneumatic or hydraulic cylinder which engages the band or bands by means of a cable.

BRIEF DESCRIPTION OF THE DRAWING

With the above and additional objects and advantages in view, as will hereinafter appear, this invention comprises the devices, combinations and arrangements of parts hereinafter described by way of example and illustrated in the accompanying drawing of a preferred embodiment in which:

The drawing shows a schematic representation of the apparatus of the present invention for applying or folding over the shaft edge into a plane which is normal to the longitudinal direction of the last, with the zone of the ball and joint part of the last being shown in cross-section together with, in part, other elements of the apparatus.

DETAILED DESCRIPTION OF THE PREFERRED EMBODIMENT

Referring now to the drawing, a last 1 of a point lasting machine is shown in cross-section at the ball and joint part thereof, where it is felt that a complete showing of the commercially available point lasting machine is not necessary for an understanding of the present invention. An insole 2 of a shoe is secured to the last sole by conventional means known in the art. A shoe shaft or upper 3 is drawn or positioned over the last 1. The lasting edge 4 of the shaft or upper 3 is disposed below the underside of the insole 2 as shown in phantom lines, so that the edge 4 can be laid or folded against the underside of the insole 2 as shown in solid lines.

Two presser members 5 are shown, with one presser member 5 being disposed on each side of the last 1 so that the ends of the presser members face towards the last. Accordingly, the front or working end of each presser member 5 is provided with a cushion 6 to supply an elastic body which can adapt itself to the contour of the side surface of the last. Each presser member 5 is seated on a front end of a piston rod 7 of a piston-cylinder arrangement 8, being secured thereto by conventional fastening means. The piston-cylinder arrangement 8 may include either a pneumatic or hydraulic cylinder. The cylinder is held or secured by conventional means, such as by a bracket 9 which is firmly secured to the point lasting machine. The piston rod 7 moves in the direction of the arrows as shown in the drawing, under the influence of either the hydraulic or pneumatic medium, in both directions towards and away from the side wall of the last 1 by passing and retraction thereof.

A band 11, preferably fabricated from an elastic material, for example rubber, is fastened at one end thereof onto an upper side of the presser member 5 at location 10, there being one band 11 for each presser member 5. Each band 11 extends from the location 10 over the elastic cushion 6 and downwardly between the elastic cushion 6 and the side of the last. Each band 11 then extends downwardly following the contours of the cushion and last, and around the last edge, then continues obliquely downwardly to extend to the other side of the last, as shown in the drawing. The other end of each band 11 is articulated or secured, at a sufficient distance from the working parts or tools of the lasting machine, onto an end of a cable 19, such as a Bwoden cable, by conventional fastening means 12.

The cable envelope or tube 13, through which the cable 19 passes, is secured at both ends 14 and 15 to the lasting machine frame by fastening means well known in the art. The drive end 16 of the cable 19 is connected to a piston rod 17 of a pneumatic or hydraulic cylinder 18. The piston rod 17 travels in and out of the cylinder 18, under the influence of the hydraulic or pneumatic medium, in the direction of the arrows shown in the drawing, so that the band 11 is either tensioned when the piston rod 17 is retracted into the cylinder 18 or relaxed when the piston rod 17 is pushed out of the cylinder 18.

The solid lines shown in the drawing of the band 11 indicate the position of the band 11 under tension by the piston rod 17. Accordingly, the phantom lines shown in the drawing of the band 11 indicate the position of the band 11 in the relaxed state thereof when the piston rod 17 is pushed out of the cylinder 18. Since the arrangement of the two presser members 5 and bands 11 is essentially symmetrical it was brought necessary to show or represent, as illustrated in the drawing, only one side of the apparatus of the present invention for folding over and applying the shaft edge for a complete understanding thereof.

Conventional valves are provided in the double-acting cylinders 8 and 18 to control the piston movements thereof. These valves are automatically switched by conventional means in the course of the program prescribed for the lasting machine, such programming being well known in the art. In operation, the presser members 5 first exert pressure against the last 1 so that the bands 11 and shoe shaft 3 are held therebetween as shown in the drawing. After the presser members 5 are in the latter position, the cylinders 18 are acted upon with a pressure medium to move the piston rods 17 into the cylinders 18 so that the bands 11 are tensioned by the cables 19. The tensioned bands 11 are pulled around the lower last edges as shown in the drawing so that the shaft edges 4 are folded over the insole 2.

It is noted, that the two bands 11 are offset in the longitudinal direction of the last 1, so that they do not hamper one another as they cross each other as shown in the drawing.

It should be understood, that the apparatus of the present invention is not a lasting machine, and therefore is not used to carry out the reeving process. However, the apparatus of the present invention serves rather as an attachment to a lasting machine for holding fast the shaft edge in its applied folded position, as set forth above. Accordingly, the folding of the shaft edge takes place immediately before the reeving process. Thus, as stated above, it is ensured or made certain that the leather or shaft edge cannot escape the pre-positioned reeving tools, particularly the ends of these reeving tools, during the reeving process performed by the lasting machine.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Apparatus for a point lasting machine to fold over an edge of a shaft of a shoe at a ball and joint part of a last of the machine, said apparatus comprising movable presser means for applying pressure against a side surface of the last having the shaft positioned thereon, band means connected to said presser means for folding over the shaft edge against an underside of an insole of the shoe and for holding the shaft edge in its folded position against the insole, said band means extending transversely entirely across an underside of the last from said presser means on one side of the last to an opposite side of the last for positioning against the shaft and the shaft edge, and a tensioning device connected to said band means from the opposite side of the last for tensioning said band means against the shaft and the shaft edge to fold and hold the shaft edge.

2. Apparatus according to claim 1, wherein said band means includes a band fabricated from an elastic material.

3. Apparatus according to claim 1, wherein said presser means includes an elastic member disposed at a working end thereof, said band means being laid over said elastic member and extending partially around said elastic member.

4. Apparatus according to claim 3, wherein said elastic member is constructed as a cushion.

5. Apparatus according to claim 4, wherein said band means includes a band fabricated from an elastic material.

6. Apparatus according to claim 1, wherein said tensioning device is driven by a cylinder.

7. Apparatus according to claim 6, wherein said band means includes a band fabricated from an elastic material.

8. Apparatus according to claim 3, wherein at least a portion of said band means is positioned between said elastic member and the shaft when said presser means applies pressure against the last.

9. Apparatus according to claim 1, wherein second presser means are provided for association with an opposite side surface of the last, second band means being connected to said second presser means, and wherein said first mentioned and second band means criss-cross each other beneath the last without interferring with each other.

10. Apparatus according to claim 9, wherein said first mentioned and second band means are longitudinally spaced from each other in a direction along a length of the last.

11. Apparatus according to claim 1, wherein said tensioning device includes cable means connected between said band means and a drive member of said tensioning device.

12. Apparatus for a point lasting machine to fold over an edge of a shaft of a shoe at a ball and joint part of a last of the machine, said apparatus comprising movable presser means for applying pressure against a side surface of the last having the shaft positioned thereon, band means connected to said presser means for folding over the shaft edge against an underside of an insole of the shoe and for holding the shaft edge in its folded position against the insole, said band means extending transversely from said presser means for positioning against the shaft and the shaft edge, a tensioning device connected to said band means for tensioning said band means against the shaft and the shaft edge to fold and hold the shaft edge, said tensioning device being driven by a cylinder, said band means including a band fabricated from an elastic material, and said tensioning device including a cable connected between said band and said cylinder.

13. Apparatus according to claim 12, wherein said cylinder is a hydraulic cylinder.

14. Apparatus according to claim 12, wherein said cylinder is a pneumatic cylinder.

15. Apparatus for a point lasting machine to fold over an edge of a shaft of a shoe at a ball and joint part of a last of the machine, said apparatus comprising movable presser means for applying pressure against a side surface of the last having the shaft positioned thereon, band means connected to said presser means for folding over the shaft edge against an underside of an insole of the shoe and for holding the shaft edge in its folded position against the insole, said band means extending transversely from said presser means for positioning against the shaft and the shaft edge, a tensioning device connected to said band means for tensioning said band means against the shaft and the shaft edge to fold and hold the shaft edge, said tensioning device including cable means connected between said band means and a drive member of said tensioning device, and said band means including a band fabricated from an elastic material.

* * * * *